US007121932B2

(12) United States Patent
Liao

(10) Patent No.: US 7,121,932 B2
(45) Date of Patent: Oct. 17, 2006

(54) PORTABLE DRILL SHARPENER

(76) Inventor: Ming-Ko Liao, No. 47, Lane 221, Ren Hua Rd., Ta-Li City, Taichung (TW)

( * ) Notice: Subject to any disclaimer, the term of this patent is extended or adjusted under 35 U.S.C. 154(b) by 0 days.

(21) Appl. No.: 11/171,441

(22) Filed: Jul. 1, 2005

(65) Prior Publication Data

US 2006/0009137 A1 Jan. 12, 2006

Related U.S. Application Data

(63) Continuation-in-part of application No. 10/883,856, filed on Jul. 6, 2004, now abandoned.

(51) Int. Cl.
*B24B 23/00* (2006.01)

(52) U.S. Cl. ..... 451/179; 451/231; 451/375; 451/349

(58) Field of Classification Search ..... 451/178, 451/179, 180, 215, 231, 375, 344, 349, 358, 451/359

See application file for complete search history.

(56) References Cited

U.S. PATENT DOCUMENTS

| | | | | |
|---|---|---|---|---|
| 5,311,703 | A * | 5/1994 | Ketteringham | 451/65 |
| 5,649,853 | A * | 7/1997 | Kuo | 451/178 |
| 6,071,181 | A * | 6/2000 | Wightman et al. | 451/192 |
| 6,113,477 | A * | 9/2000 | Arai | 451/241 |
| 6,652,367 | B1 * | 11/2003 | Lin | 451/178 |
| 6,676,500 | B1 * | 1/2004 | Lin | 451/359 |

* cited by examiner

*Primary Examiner*—Jacob K. Ackun, Jr.
(74) *Attorney, Agent, or Firm*—Rosenberg, Klein & Lee

(57) ABSTRACT

A portable drill sharpener includes a casing, a sand-wheel, a positioning device, a first grinding unit and a second grinding unit, a holding member for positioning a drill to be ground, a first adjustment unit and a second adjustment unit respectively connected to the first and second grinding units. Each of the first and second adjustment unit includes a guide rail and a sliding frame is movably mounted on the guide rail. The fist and second grinding units have at least one axle along which the first and second grinding units are adjusted.

7 Claims, 7 Drawing Sheets

PORTABLE DRILL SHARPENER

FIELD OF THE INVENTION

This is a Continuation-In-Part application of applicant's former application Ser. No. 10/883,856, filed Jul. 6, 2004 now abandoned.

BACKGROUND OF THE INVENTION

A conventional drill sharpener is a bulky machine which is expensive and is mainly used for factories. A portable drill sharpener known to applicant includes a casing with a transmission mechanism which, a sand-wheel for sharpening drills and a guide device. The sand-wheel is rotated by the transmission mechanism and the drill is positioned by the guide device so as to be sharpened by the sand-wheel. Nevertheless, the portable drill sharpener can only sharpen limited areas of drills and cannot meet professional requirements.

The present invention intends to provide a portable drill sharpener that ensures every surface of the drills can be sharpened.

SUMMARY OF THE INVENTION

The present invention relates to a portable drill sharpener which has a portable drill sharpener that comprises a casing having a power supply for driving a sand-wheel. A positioning device, a first grinding unit and a second grinding unit are connected to the casing. A holding member is used to position a drill to be ground. A first adjustment unit and a second adjustment unit are respectively connected to the first and second grinding units. Each of the first and second adjustment unit includes a guide rail and a sliding frame which is movably mounted on the guide rail. The fist and second grinding units have at least one axle along which the first and second grinding units are adjusted.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
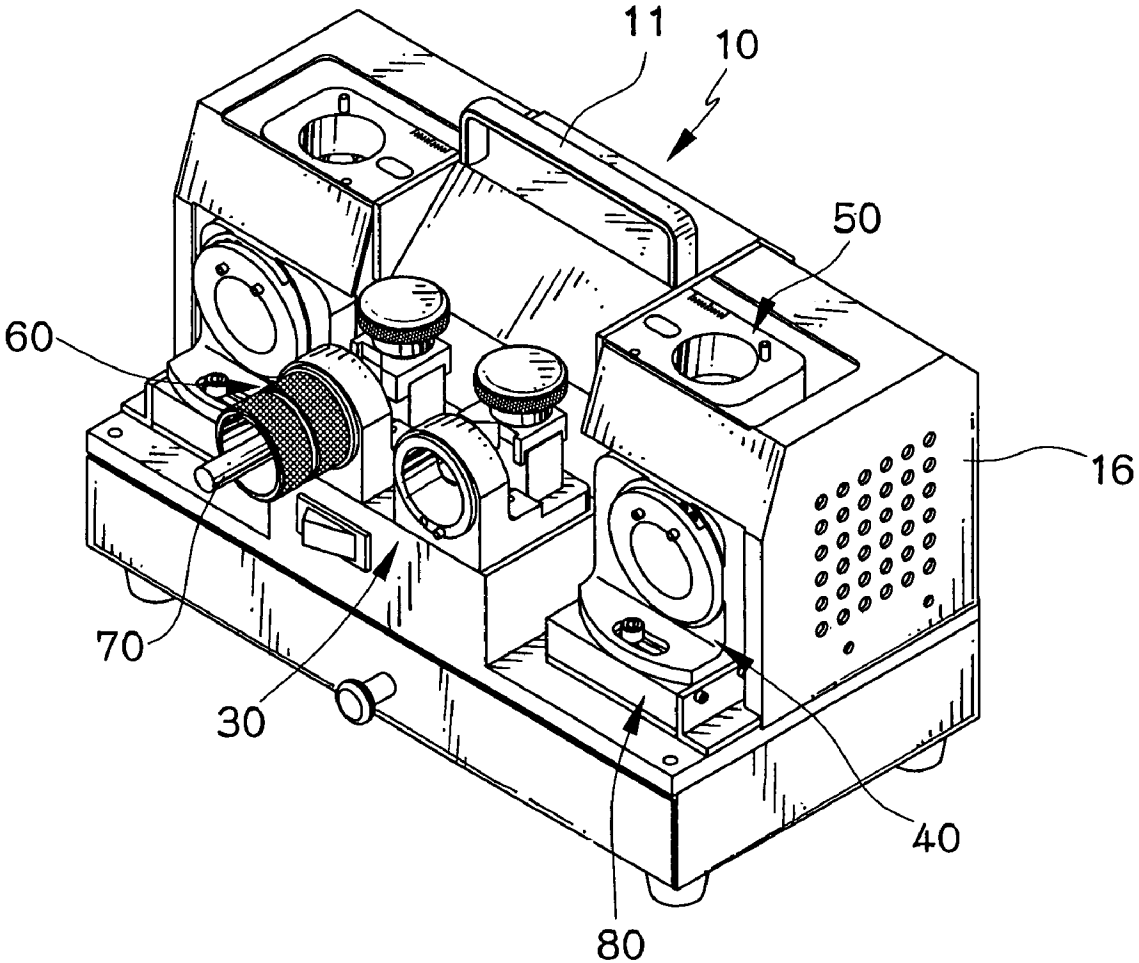
FIG. 1 is a perspective view of the portable drill sharpener of the present invention.
Figure 2:
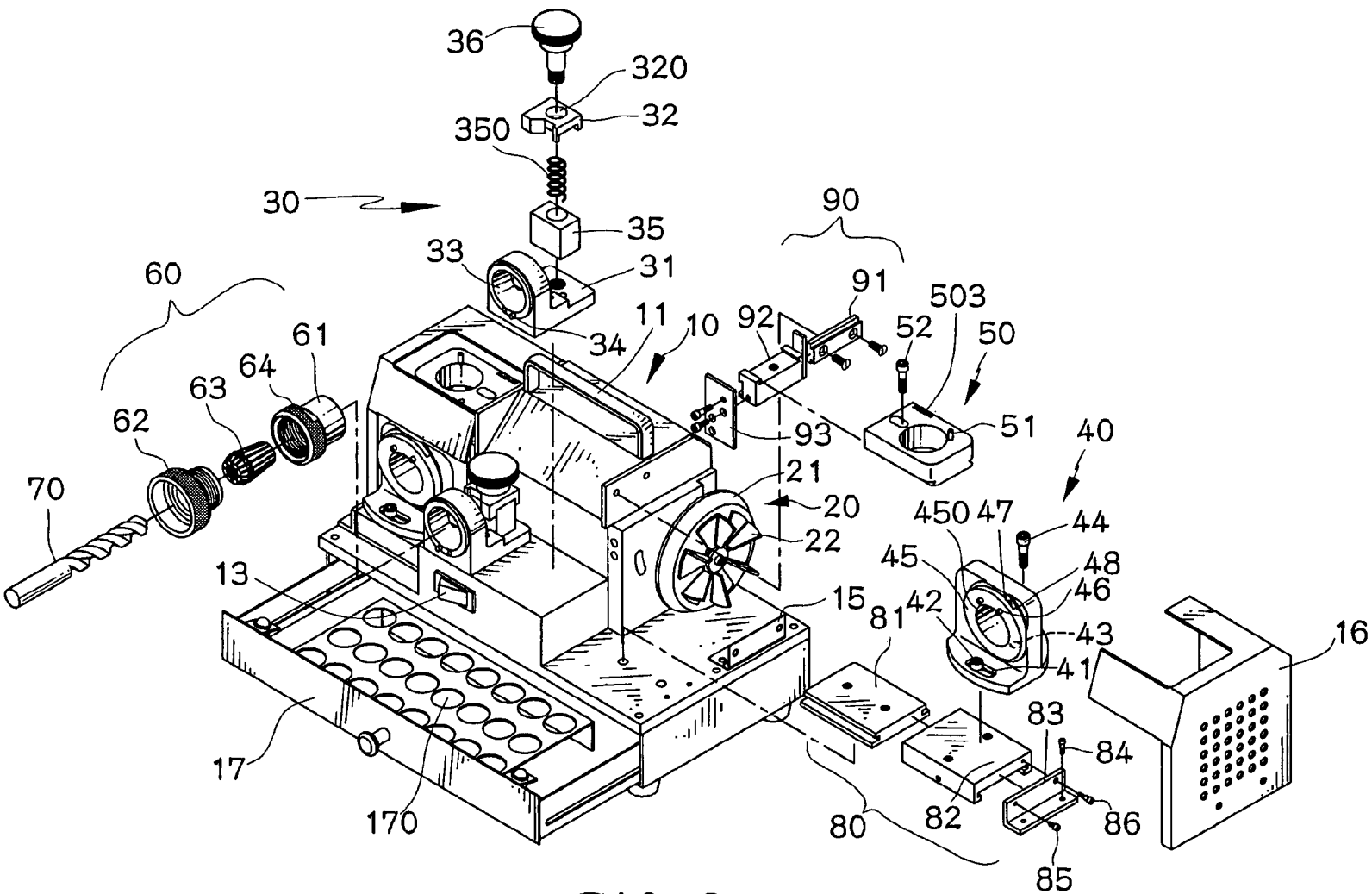
FIG. 2 is an exploded view to show the drill sharpener of the present invention.
Figure 3:
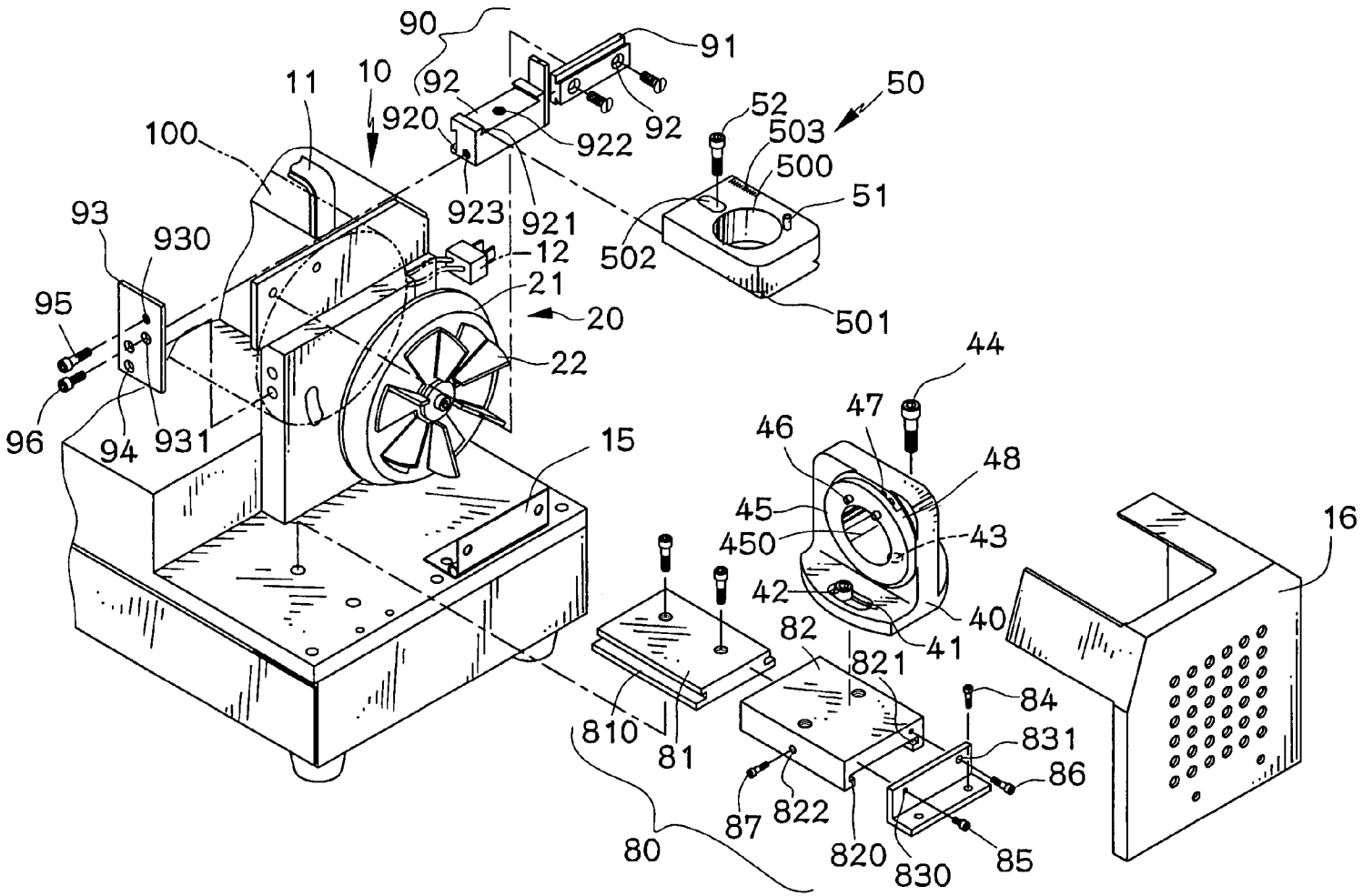
FIG. 3 is another exploded view of the drill sharpener of the present invention.

Referring to FIGS. 1 to 3, the portable drill sharpener of the present invention comprises a casing 10 has a sand-wheel 20, a positioning device 30, a first grinding unit 40 and a second grinding unit 50. A holding member 60 is used to position a drill 70 to be ground. A first adjustment unit 80 and a second adjustment unit 90 are respectively connected to the first and second grinding units 40, 50. The fist and second grinding units 40, 50 have a mono-axis or dual-axes along which the first and second grinding units 40, 50 are adjusted.

The casing 10 has a handle 11 on a top thereof and a grinding chamber 14 is defined in an end of the casing 10. A cover 16 is pivotably connected to casing 10 by a hinge 15 so as to close the grinding chamber 14. A power source 100 is received in the casing 10 and connected with a power supply 12 and a switch 13 is connected to the casing 10 so as to activate the power source 100 to drive a sand-wheel 20 located in the grinding chamber 14 via a transmission device such as a reduction gear set. The cover 16 prevents the debris flying during grinding and the user may clean up the debris in the chamber 14 by opening the cover 16. A drawer 17 is retractably received in the casing 10 and includes a plurality of recesses 170 so as to receive holding members 60 and the drills 70 to be ground.

The sand-wheel 20 includes a rough grinding surface 21 which has a inclination to fit the inclination of the lips of the drills. A plurality of heat dispensing fins 22 extend radially from an upright surface of the sand-wheel 20 so as to remove heat from the sand-wheel 20 during operation.

The positioning device 30 for sharpening lip clearance of a drill 70 is connected to the outside of the casing 10 and includes a base 31 in which a holding member 60 is inserted, and a drill positioning mold 32 which is located on a common axis with the base 31 and separated from the base 31 at a distance which will be defined hereinafter. The base 31 has a hole 33 for receiving the holding member 60 and a limitation rod 34 is located around the hole 33. The drill positioning mold 32 has a positioning holes 320 which are shaped to be engaged with the tips of the drills 70 to be ground. The positioning holes 320 include planes at different angles or curve surfaces. An engaging portion 321 is located a lower portion of the drill positioning mold 32 so as to maintain the fixing frame 35 at a desired orientation. An underside of the drill positioning mold 32 is engaged with the fixing frame 35 and a resilient member 350 is received in the fixing frame 35 so as to support the drill positioning mold 32. An adjustment knob 36 extends through the drill positioning mold 32 and is threadedly connected to the fixing frame 35 so as to make the drill positioning mold 32 face the tip of the drill 70 to be ground, and the drill positioning mold 32 is fixed to the fixing frame 35 by the adjustment knob 36.

The fist grinding unit 40 is fixed on the casing 10 and angle adjustable in horizontal direction. The first grinding unit 40 is located on the same axis of the sand-wheel 20 and is located at a distance from the sand-wheel 2, the distance is the same as the distance between the fixing frame 31 and the drill positioning mold 32. The first grinding unit 40 is an L-shaped member and has a curve adjustment slot 41 defined in a horizontal portion thereof and an adjustment bolt 42 extends through the adjustment slot 41 to fix the first grinding unit 40 on the casing 10. A positioning device 43 is connected to the underside of the first grinding unit 40 and a positioning bolt 44 extends through the positioning device 43, so that the first grinding unit 40 can be rotated an angle relative to the sand-wheel 20 about the positioning bolt 44. Therefore, the sand-wheel 20 is allowed to grind different types of drills 70 at different angles.

A rotatable frame 45 is connected to a vertical wall of the first grinding unit 40 and has an insertion hole 450 inclinedly defined in a center thereof so that a holding member 60 is inclinedly inserted into the insertion hole 450. A positioning member 46 is connected to an outside of the rotatable frame 45 and a plurality of limitation rods 47, 48 extend from the first grinding unit 40 so as to limit the rotation of the rotatable frame 45. The inclination of the insertion hole 450 is in a range of positive (upward) 10–25 degrees.

Referring to FIGS. 2 to 5, an adjustment device 80 is connected to the underside of the first grinding unit 40 so as to move the first grinding unit 40 along a common axis of the sand-wheel 20. The adjustment device 80 is fixed to the casing 10 and includes an I-shaped guide rail 81 and two flanges 810 on two sides thereof. A sliding frame 82 is movably mounted on the guide rail 81 and includes two hooks 820 which are located corresponding to the flanges 810. The sliding frame 82 is connected to the adjustment bolt 42 and positioning bolt 44 on the first grinding unit 40. An end piece 83 is located at an end of a combination of the guide rail 81 and the sliding frame 82 so as to limit the movement of the sliding frame 82. The end piece 83 is fixed at a bottom thereof by bolts 84 and a stop hole 830 and a limitation hole 831 are defined in a vertical portion of the end piece 83. Two bolts 85, 86 respectively extend through the stop hole 830 and the limitation hole 831. A section of the bolt 85 extends beyond the stop hole 830 to stop the sliding frame 82. A connection hole 821 is defined in an end surface of the sliding frame 82 and the bolt 86 extends through the limitation hole 831 and is threadedly connected to the connection hole 821 to limit a travel of the sliding frame 82 by the engagement of a head of the bolt 86 and the limitation hole 831. The sliding frame 82 can also be fixed to the guide rail 81. A fixing hole 822 is defined in the sliding frame 82 so that a fixing bolt 87 threadedly extends through the fixing hole 822 and contacts against the guide rail 81 to prevent the sliding frame 82 from moving relative to the guide rail 81.

The second grinding unit 50 has a through hole 500 defined in a top thereof so as to receive the holding member 60 and a positioning member 51 extends from the top of the second grinding unit 50 so as to be engaged with the holding member 60. Two guide portions 501 are connected to two sides of the second grinding unit 50 so as to be cooperated with the adjustment unit 90. As shown in FIGS. 2, 3, 6 and 7, a limitation port 502 is defined in the second grinding unit 50 and located above the adjustment unit 90 and a limitation bolt 52 extends through the limitation port 502 and is threadedly connected to the adjustment unit 90. The second grinding unit 50 has alignment portion 503 on an end surface thereof and located close to the adjustment unit 90 so that the users know the distance of the second grinding unit 50.

The adjustment unit 90 includes a guide rail 91 and a sliding frame 92. The guide rail 91 is fixed on the casing 10 and includes dove-shaped flanges 910 and the sliding frame 92 has dove-shaped hooks 920 for being hooked with the flanges 910. The second grinding unit 50 is mounted on the sliding frame 92 of the adjustment unit 90 and the sliding frame 92 includes two dove-shaped guide portions 921 on two sides thereof so that the guide portions 501 are slidably engaged therewith. The second grinding unit 50 is moved vertically on the sliding frame 92. The limitation bolt 52 that extends through the limitation port 502 is threadedly connected to a threaded hole 922 of the sliding frame 92.

An end piece 93 is located at an end of a combination of the sliding frame 92 and the guide rail 91. The end piece 93 is fixed to the casing 10 by bolts 94. A stop hole 930 and a limitation hole 931 are defined in the end piece 83, two bolts 95, 96 respectively extend through the stop hole 930 and the limitation hole 931. A section of the bolt 95 extends beyond the stop hole 930 to stop the sliding frame 92. A connection hole 923 is defined in an end surface of the sliding frame 92 and the bolt 96 extends through the limitation hole 931 and is threadedly connected to the connection hole 923 to limit a travel of the sliding frame 92. The sliding frame 92 can also be fixed to the guide rail 91. A fixing hole 922 is defined in the sliding frame 92 so that the limitation bolt 52 threadedly extends through the fixing hole 922 and contacts against the guide rail 91 to prevent the sliding frame 92 from moving relative to the guide rail 91.

Figure 4:
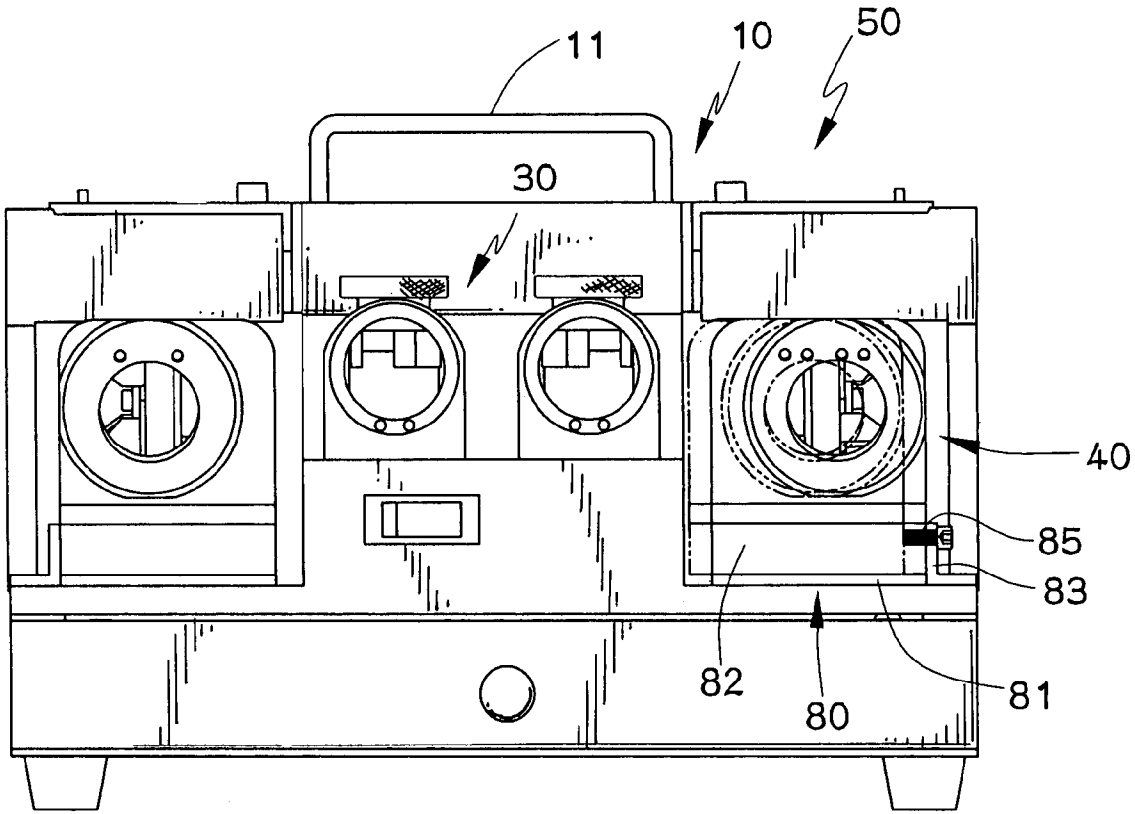
FIG. 4 is a front plan view of the drill sharpener of the present invention.
Figure 5:
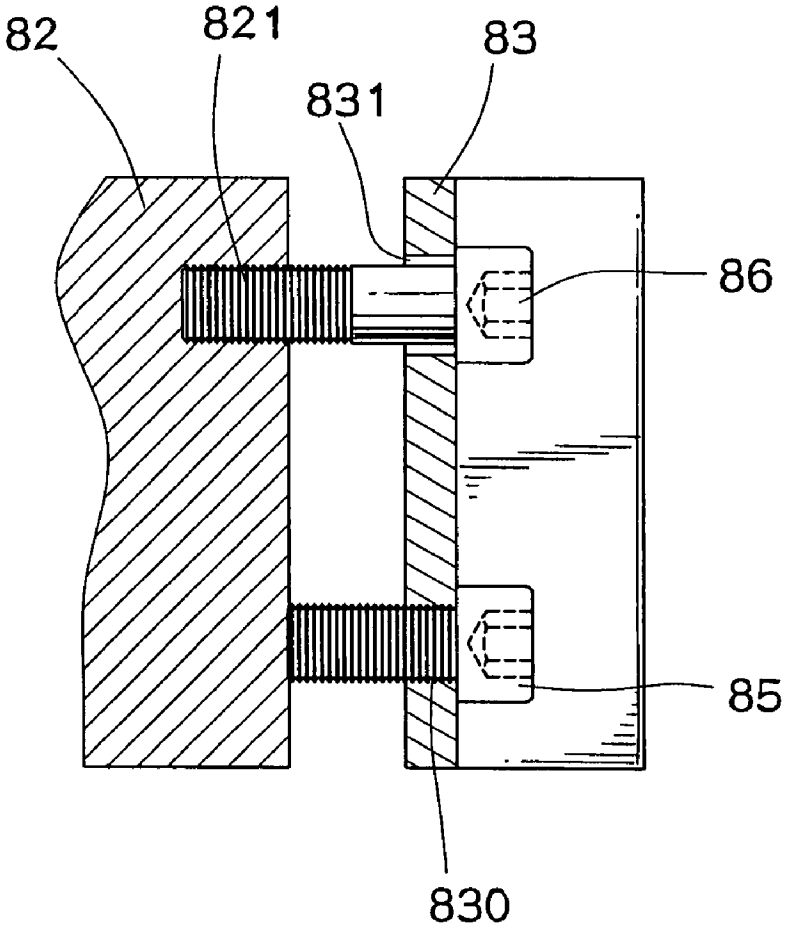
FIG. 5 shows the sliding frame and the two bolts extending through the stop hole and the limitation hole.
Figure 6:
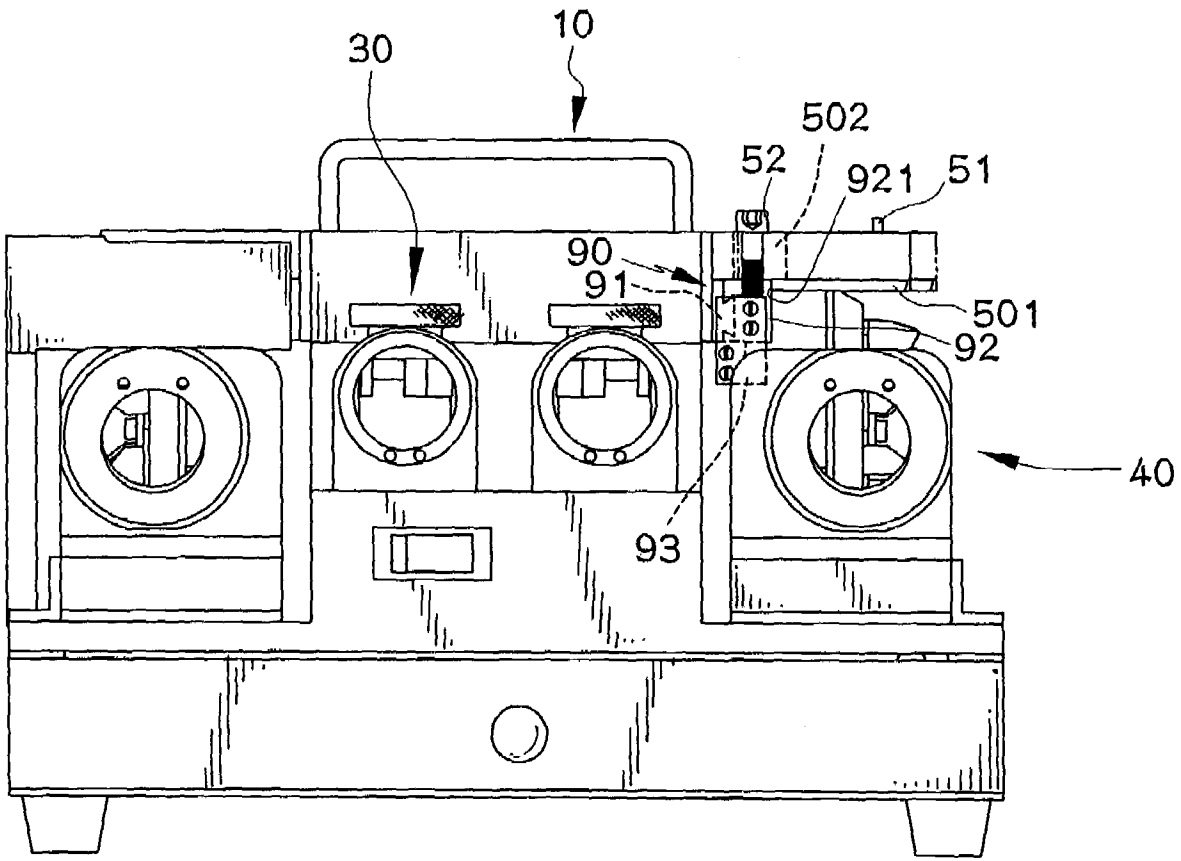
FIG. 6 shows that the second grinding unit moves along the first axis.
Figure 7:
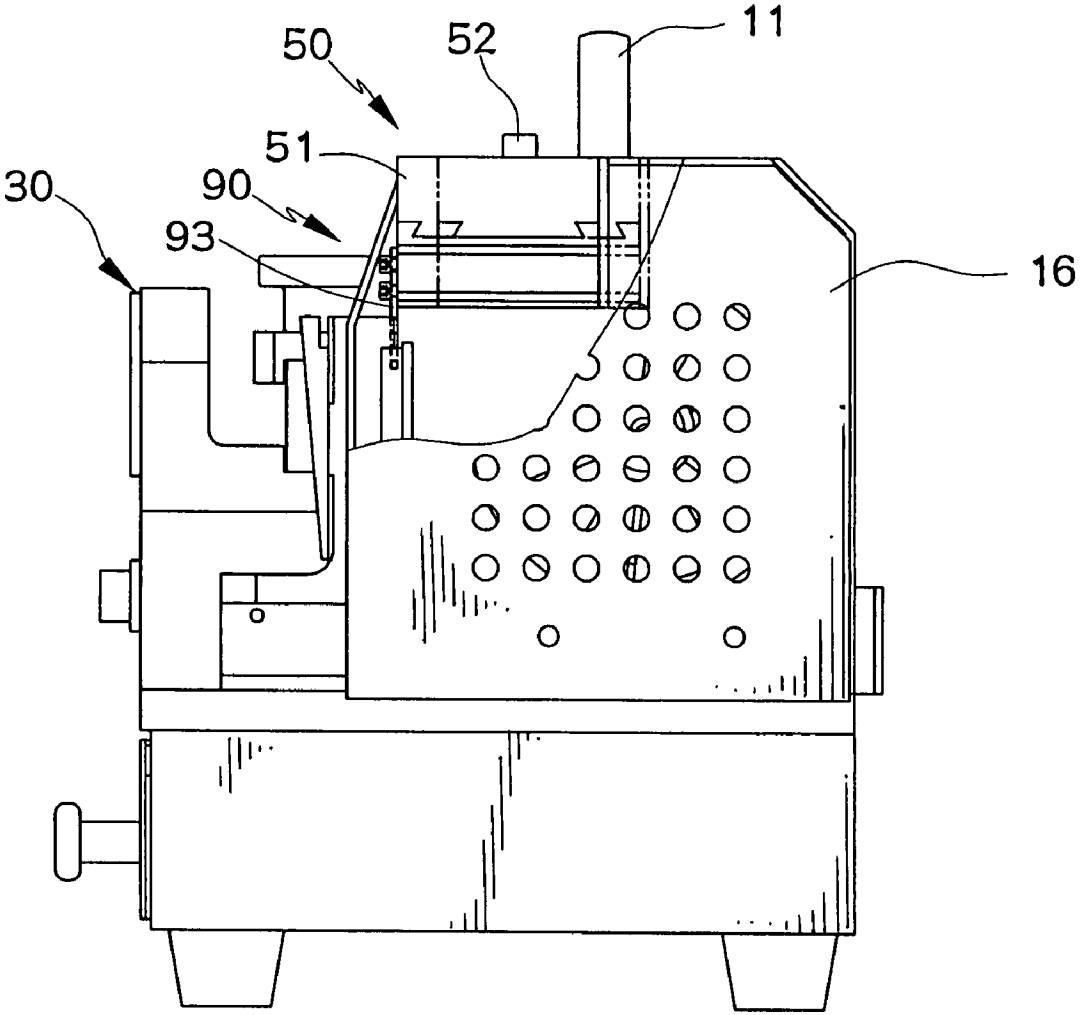
FIG. 7 shows that the second grinding unit moves along the second axis.

Referring to FIGS. 2 to 4, the clamping member 60 includes a body 61 and a flexible clamping device 62 is installed in the clamping member 60. The flexible clamping device 62 includes a plurality of axially extended slits so as to form a plurality of pawls such that when rotating a nut 63 on the body 61. The pawls 62 can be expanded outward or closed together to secure the drills 70. A limitation portion 64 is defined in a conjunction portion of the large diameter section and the small diameter portion of the body 61 and the number of the limitation portion can be set according to the lips or edges of the drill 70.

The drill 70 is held by the holding member 60 and positioned in the positioning device 30, the holding member 60 is then moved to the first and second grinding units 40, 50. By the cooperation of the rotatable frame 45, the positioning member 46, the limitation rods 47, 48 on the first grinding unit 40 and the positioning member 51 on the second grinding unit 50, the drill 70 can be well ground. The first and second grinding units 40, 50 can be moved along the axis of the sand-wheel 20 by the adjustment unit 80, 90 so as to grind the drills 70 conveniently.

While we have shown and described the embodiment in accordance with the present invention, it should be clear to those skilled in the art that further embodiments may be made without departing from the scope of the present invention.

What is claimed is:

1. A portable drill sharpener comprising:

a casing (10) having a power supply (100), said power supply driving a sand-wheel (20);

a positioning device (30), said positioning device being coupled to said casing;

a first grinding unit (40) being fixed on said casing (10) and displaceable in a horizontal direction, said first grinding unit (40) having an adjustment slot (41) and an adjustment bolt (42) extending through said adjustment slot (41), said adjustment bolt (42) fixing said first grinding unit (40) on said casing (10);

a rotatable frame (45) coupled to a vertical wall of said first grinding unit (40) having an insertion hole (450) defined through a center of said rotatable frame (45);

a holding member (60) being positioned within said insertion hole (450) at an inclined angle;

a positioning member (46) coupled to an outside of said rotatable frame (45);

a plurality of limitation rods (47, 48) extending from said first grinding unit (40) for limiting the rotation of said rotatable frame (45);

a first adjustment unit (80) coupled to a bottom of said first grinding unit (40) for displacing said first grinding unit (40) along a common axis of said sand-wheel (20), said adjustment unit (80) being fixedly attached to said casing (10) and having a guide rail (81) with two flanges on two sides thereof;

a sliding frame (82) mounted on said guide rail (81) and having two hooks (820) corresponding to said two flanges (8100, said sliding frame (82) coupled to said adjustment bolt (42) and a positioning bolt (44) of said first grinding unit (40);

an end piece (83) positioned at one end of said first adjustment unit (80) for limiting displacement of said sliding frame (82);

a second grinding unit (50), said second grinding unit being coupled to said casing;

a holding member (60) adapted to position a drill (70) to be ground; and a second adjustment unit (90) respectively connected to the second grinding units (50), said second adjustment unit (90) including a guide rail (91) and a sliding frame (92), said sliding frame (92) being slidably mounted on the guide rail (91), the first and second grinding units (40), (50) having at least one axis along which the first and second grinding units are adjustable.

2. The sharpener as recited in claim 1, further comprising a plurality of bolts (84) fixing said end piece (83) to said casing (10);

a stop hole (830) and a limitation hole (831) defined on a vertical portion of the end piece (83);

a bolt (85) extending through the stop hole (830), a section of the bolt (85) extending beyond the stop hole (830) for stopping the sliding frame (82);

a bolt (86) extending through said limitation hole (831) and being threadedly connected to a connection hole (821), said connection hole (821) being defined on an end surface of said sliding frame (82), said bolt (86) limiting displacement of said sliding frame (82).

3. The sharpener as recited in claim 1, further comprising a fixing hole (822), said fixing hole (822) being defined in the sliding frame (82); and a fixing bolt (87) threadedly extending through the fixing hole (822), wherein said fixing bolt (87) and contacts said guide rail (81) thereby preventing the sliding frame (82) from being displaced relative to the guide rail (81).

4. A portable drill sharpener comprising:

a casing (10) having a power supply (100), said power supply driving a sand-wheel (20);

a positioning device (30), said positioning device being coupled to said casing;

a first grinding unit (40) and a second grinding unit (50) each respectively coupled to said casing;

a holding member (60) adapted to position a drill (70) to be ground;

a first adjustment unit (80) and a second adjustment unit (90) respectively connected to the first grinding unit (40) and the second grinding unit (50), said first adjustment units (80) having a guide rail (81) and a sliding frame (82), said sliding frame (82) being slidably mounted on said guide rail (81), said first and second grinding units (40), (50) having at least one axis along which the first and second grinding units (40), (50) are adjustable, said second grinding unit (50) having a through hole (500) defined on a top end thereof; and a positioning member (51) extending from the top end of the second grinding unit (50) and being in engagement with the holding member (60);

two guide portions (501) being coupled to two sides of the second grinding unit (50) and being in cooperation with the adjustment unit (90);

a limitation port (502) defined in the second grinding unit (50) being located above the adjustment unit (90); and a limitation bolt (52) extending through the limitation port (502) and being threadedly connected to the second adjustment unit (90), the second adjustment unit (90) having a guide rail (91) and a sliding frame (92), said sliding frame (92) being slidably mounted on said guide rail (91), the guide rail (91) being fixedly attached to the casing (10) and having flanges (910), the sliding frame (92) having hooks (920) for coupling with the flanges (910).

5. The sharpener as recited in claim 4, wherein the second grinding unit (50) has alignment portion (503) on an end surface thereof and positioned near said adjustment unit (90).

6. The sharpener as recited in claim 4, wherein said second grinding unit (50) being mounted on the sliding frame (92) of the adjustment unit (90) said sliding frame (92) having two guide portions on two sides thereof, said guide portions (501) slidably engaged to said sliding frame (92), the limitation bolt (52) extending through the limitation port (502) and being threadedly connected to a threaded hole (922) of the sliding frame (92).

7. The sharpener as recited in claim 4, further comprising an end piece (93) located at an end of said second adjustment unit, the end piece (93) being fixedly attached to said casing (10) by bolts (94);

a stop hole (930) and a limitation hole (931) being defined in the end piece (83)

a set of bolts (95, 96) respectively extending through the stop hole (930) and the limitation hole (931), a section of the bolt (95) extending beyond the stop hole (930) to stop the sliding frame (92), the bolt (96) extends through the limitation hole (931) and being threadedly connected to a connection hole (923) to limit a travel of the sliding frame (92), said connection hole (923) being defined on an end surface of said sliding frame (92).

* * * * *